US005082124A

United States Patent [19]

Bonvini et al.

[11] Patent Number: 5,082,124

[45] Date of Patent: Jan. 21, 1992

[54] GRID FOR ELECTRICAL HOUSEHOLD APPLIANCES, MADE FROM A THERMOPLASTIC MATERIAL

[75] Inventors: Alberto Bonvini, Gorgonzola; Francesco Mascia, Guanzate, both of Italy

[73] Assignee: Centro Sviluppo Settori Impiego S.r.l., Milan, Italy

[21] Appl. No.: 601,622

[22] Filed: Oct. 23, 1990

[30] Foreign Application Priority Data

Oct. 23, 1989 [IT] Italy ..... 21983/89[U]

[51] Int. Cl.[5] ..... A47F 5/00

[52] U.S. Cl. ..... 211/153; 108/901

[58] Field of Search ..... 211/153, 134; 108/901; 248/346.1, 346

[56] References Cited

U.S. PATENT DOCUMENTS 3,446,361 5/1969 Douty ..... 211/153

FOREIGN PATENT DOCUMENTS 301754 9/1954 Switzerland ..... 211/153

*Primary Examiner*—Robert W. Gibson, Jr.

*Attorney, Agent, or Firm*—Morgan & Finnegan

[57] ABSTRACT

This application discloses a grid for electric household appliances made from a thermoplastic polymer, comprising a peripheral edge whose perimeter is of substantially quadrangular shape, and a plurality of rods inserted inside said edge, parallel to one of the sides of the perimeter, and united to said edge without discontinuities.

6 Claims, 1 Drawing Sheet

GRID FOR ELECTRICAL HOUSEHOLD APPLIANCES, MADE FROM A THERMOPLASTIC MATERIAL

FIELD OF THE INVENTION

The present invention is concerned with a grid, made from a thermoplastic material, for use in electric household appliances.

More particularly, the subject-matter of the present invention is a support or separation grid, made from a thermoplastic material, for use inside interiors of refrigerators and freezers.

BACKGROUND OF THE INVENTION

According to the present state of the art, the grids for use inside said electric household appliances are constituted by metal rods with circular cross sections, generally made from iron material, chrome-plated or painted, and united with each other by electric spotwelding.

A drawback shown by these metal grids according to the prior art is that, notwithstanding the protecting treatments, they show a tendency to rust, in particular, near the welded spots, with consequent separations and breakages, difficult to repair.

Replacing the iron material with other, oxidation resistant, materials, such as, e.g., titanium, nickel alloys, and so forth, is disadvantageous from an economic view point.

The present Applicant has found now that the drawback shown by the metal grids can be easily overcome, in an additionally economically advantageous way, if the iron material is replaced with a thermoplastic polymer used in a suitable fashion.

DESCRIPTION OF THE INVENTION

Therefore, the object of the present invention is for electric household appliances made from a thermoplastic polymer, which grid is preferably obtained by molding inside a single mold, and comprises a peripheral edge whose perimeter is of substantially quardrangular shape, and a plurality of rods inserted inside said edge, parallel to one of the sides of the perimeter, and united to said edge without discontinuities.

Therefore, the grid according to the present invention is constructed as one enbloc body, in that it is obtained by one single molding operation. It has dimensions which only depend on the type and shape of the electric household appliance inside whose interior it has to be used. Said dimensions are usually within the range of from 30 to 150 cm, as measured along each side of the peripheral edge.

Both the peripheral edge and the rods inside it have a diameter within the range of from 2 to 20 mm, their vertical section is preferably hollow. They have an identical surface, of circular shape, and, in case they have a hollow vertical section, they have thicknesses within the range of from 0.1 to 5 mm.

The grids according to the present invention can be prepared by starting from any thermoplastic material. Illustrative examples comprise: polypropylene, polystyrene, impact-resistant polystyrene, polystyrene modified with such polar monomers as acrylonitrile, styrene alloys, as ABS, SAN, and so forth, polyvinylchloride, high-, medium- and low-density polythene, ethylene-propylene copolymers, acrylic and/or methacrylic resins, polymethacrylates, polycarbonates, polyester resins, such as PET, PBT, and so forth, to which reinforcing agents, such as mineral fillers, fibers, and so forth, are possibly added.

Also mixtures of the above mentioned polymers can be used.

Preferred materials are polypropylene, polystyrenes and polyethylenes.

To manufacture the grid according to the present invention any molding technique can be used, even if the "air injection molding" technique, as disclosed in published German patent applicazion No. 2,501,314, U.K. patent No. 2,139,548, U.S. Pat. No. 4,740,150 or published European patent application Nos. 309,257 and 289,230, is the preferred technique.

BRIEF DESCRIPTION OF THE DRAWINGS

An example of a grid according to the instant invention is shown in the hereto attached drawing, in which.

Figure 1:
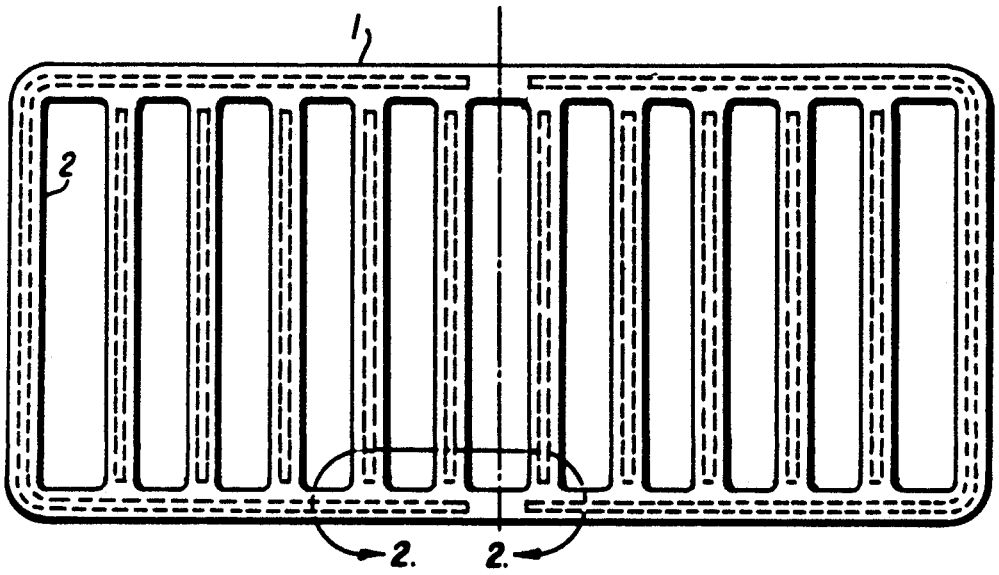
FIG. 1 shows a plan top view of a grid of rectangular shape.
Figure 2:
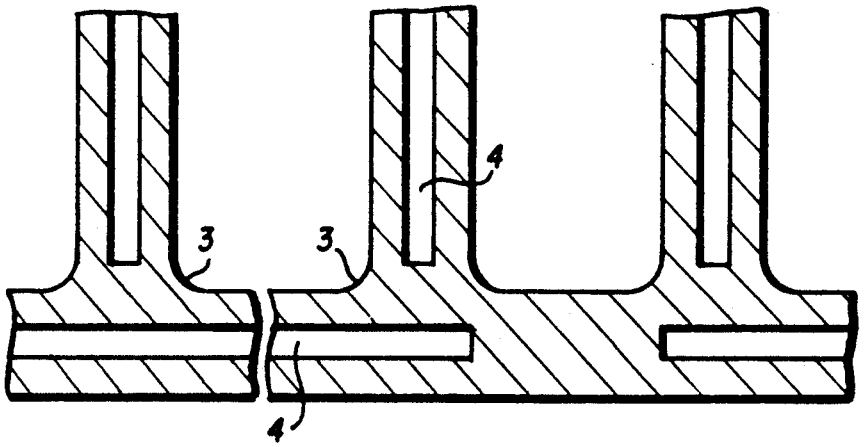
FIG. 2 shows a detail of the mutual connection of rod and perimetrical edge.

Referring to the figures, the grid according to the present invention comprises a peripheral edge (1) of substantially rectangular shape, and a plurality of rods (2), parallel to the shorter side of the rectangle, united to the edge (3) without discontinuities.

Both the edge (1) and the rods (2), molded by the "air injection moulding" technique, are provided with a longitudinal hollow (4) and have a substantially identical cross section.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

We claim:

1. Grid for electric household appliances made from a thermoplastic polymer, comprising a peripheral edge whose perimeter is of substantially quadrangular shape, and a plurality of rods inserted inside said edge, parallel to one of the sides of the perimeter and united to said edge without discontinuities, said grid obtained by molding inside a single mold.

2. Grid according to claim 1, wherein the peripheral edge and the bars have a diameter within the range of from 2 to 20 mm, and an identical surface, of circular shape.

3. Grid according to claim 1, wherein the peripheral edge and the bars have a hollow vertical section.

4. Grid according to claim 3, wherein the peripheral edge and the bars have thicknesses within the range of from 0.1 to 5 mm.

5. Grid according to claim 1, wherein the thermoplastic material is polypropylene, polystyrenes or polyethylenes.

6. Grid for electric household appliance according to claim 1, wherein the electric household appliances are refrigerators and freezers.

* * * * *